US006102548A

United States Patent [19]

Mantle et al.

[11] Patent Number: 6,102,548

[45] Date of Patent: Aug. 15, 2000

[54] LIGHTING SYSTEM FOR MAILBOX

[76] Inventors: Kellie M. Mantle; Michael A. Mantle, both of P.O. Box 256, Jersey Shore, Pa. 17740

[21] Appl. No.: 09/294,300

[22] Filed: Apr. 19, 1999

[51] Int. Cl.[7] ..... F21V 33/00

[52] U.S. Cl. ..... 362/155; 362/183; 362/276; 362/394; 362/802; 232/13

[58] Field of Search ..... 362/154–156, 362/183, 276, 394, 802; 232/13, 17, 25

[56] References Cited

U.S. PATENT DOCUMENTS

| | | | |
|---|---|---|---|
| D. 385,677 | 10/1997 | Vivirito, Jr. | D99/29 |
| 4,154,393 | 5/1979 | Darvishian | 232/36 |
| 4,648,012 | 3/1987 | Pittman, II | 362/155 |
| 4,755,915 | 7/1988 | Rogers | 362/155 |
| 4,872,095 | 10/1989 | Dubak et al. | 362/155 |
| 5,032,957 | 7/1991 | Canfield | 362/133 |
| 5,143,285 | 9/1992 | Wise | 232/39 |
| 5,155,470 | 10/1992 | Tuttle | 340/539 |
| 5,246,285 | 9/1993 | Redburn et al. | 362/276 |
| 5,522,540 | 6/1996 | Surman | 232/17 |
| 5,813,749 | 9/1998 | Sheldon | 362/155 |
| 5,975,713 | 11/1999 | Brothers | 362/155 |

*Primary Examiner*—Alan Cariaso
*Attorney, Agent, or Firm*—Edward A. McConwell, Jr.

[57] ABSTRACT

A system for illuminating the interior of a mailbox having a bottom wall, a side and arcuate top wall, a closed rear wall, an open front, and a door pivotally attached to the bottom wall for selectively closing the open front. The lighting system includes a light source positioned within the interior of the mailbox. The lighting system further includes a battery power source mounted within the mailbox. A light sensor is positioned within the mailbox for sensing the level of ambient light within the interior thereof. The lighting system includes an electromagnetic sensor that permits current from the power source to be transmitted to the light sensor upon an opening of the mailbox door. If the level of ambient light sensed by the light sensor is below a predetermined level, the light source is energized to illuminate the interior of the mailbox. Current to the light sensor and light source is interrupted upon a closing of the mailbox door.

20 Claims, 7 Drawing Sheets

LIGHTING SYSTEM FOR MAILBOX

BACKGROUND OF THE INVENTION

This invention relates generally to a lighting system for a U.S. mailbox and, more particularly, to a lighting system for a mailbox which activates an interior light upon an opening of the mailbox door if there is insufficient ambient light by which to view the contents therein.

Many persons have employment schedules that result in returning home in the dark. Of course, many persons working normal business hours also return home in the dark during the winter season due to the shortened period of daylight. The task of gathering one's mail from the mailbox is made more difficult by the darkness. The resident must scrape around inside the darkened mailbox or utilize an external light source such as a flashlight to ensure that important letters or small packages are not overlooked. Interior lighting of a mailbox is especially needed for use with rural mailboxes which are typically mounted some distance away from the home.

Various apparatus have been proposed for lighting the interior of a mailbox. Some such devices are disadvantageous, however, in that a light is activated every time the mailbox door is opened, thus depleting the power supply even in situations where ambient light is plenteous. Other devices require the user to manually activate a light switch when more light is needed.

Therefore, it is desirable to have a lighting system for a mailbox which activates an interior light only if insufficient ambient light is available for viewing the contents within the mailbox. It is further desirable that the amount of available ambient light is only sensed upon an opening of the mailbox door.

SUMMARY OF THE INVENTION

A lighting system in accordance with the present invention includes a conventional U.S. mailbox having a bottom wall, an upstanding side and arcuate top wall, a closed rear wall, and an open front. A door is pivotally coupled to the bottom wall of the mailbox and movable between open and closed positions. An incandescent light and a photoelectric light sensor are mounted within the mailbox. An electromagnetic sensor is positioned within the interior of the mailbox for sensing when the mailbox door has been opened.

When the door is opened, the electromagnetic sensor permits current to be transmitted from the power source to the light sensor. Upon activation, the light sensor measures the level of ambient light within the interior of the mailbox. If the level of ambient light is below a predetermined level, the light sensor permits current to be transmitted to the incandescent light. Current to the light sensor and light is interrupted upon a closing of the mailbox door.

It is therefore a general object of this invention to provide a lighting system for a mailbox that can activate an interior light when the ambient light within the mailbox is insufficient for viewing the contents therein.

Another object of this invention is to provide a lighting system, as aforesaid, having a photoelectric sensor for sensing the level of ambient light.

Still another object of this invention is to provide a lighting system, as aforesaid, that can activate the photoelectric sensor upon an opening of the mailbox door.

A further object of this invention is to provide a lighting system, as aforesaid, that can energize the photoelectric light sensor and light with an easily replaceable battery.

A still further object of this invention is to provide a lighting system, as aforesaid, that provides a container for exchanging money for stamps.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
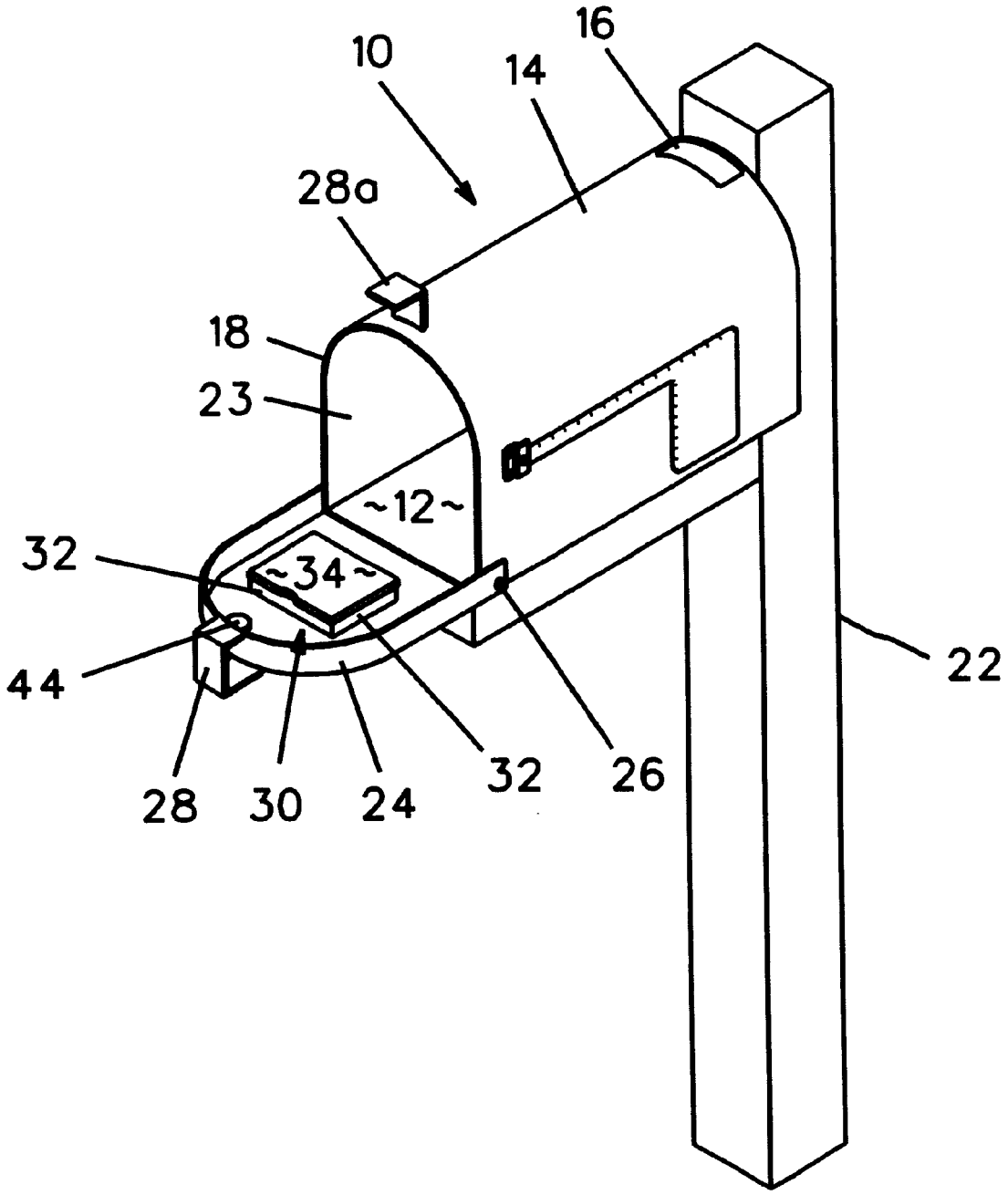
FIG. 1 is a perspective view of the mailbox lighting system according to the present invention.

A lighting system in accordance with the present invention utilizes a conventional U.S. Post Office approved mailbox 10 that has been modified to include the novel features as described below. The mailbox 10 includes a bottom wall 12 fixedly joined to an arcuate top and side wall 14. The mailbox 10 includes a closed rear wall 20 and an open front 23. The mailbox is preferably constructed of a rigid material, such as plastic, metal, wood, or other suitable material. The mailbox 10 can be mounted to a post 22 as shown in FIG. 1. The mailbox 10 includes a front door 24 pivotally attached to the bottom wall of the mailbox 10 with a pin 26 or other like fastener. The door 24 is pivotal between an open configuration (FIG. 1) and a closed configuration (FIG. 5) and is held in the closed configuration by a pair of latches 28, 28*a*.

A box-like container 30 is fixedly attached to the interior surface of the door 24. The container 30 includes four upstanding sides 32 with a lid 34 pivotally joined to one of the sides 32 (FIG. 1). The lid 34 is selectively movable between open and closed configurations. The lid 34 may be held in the closed configuration through the use of a spring hinge or through frictional-fitting fasteners (not shown), as are known in the art. The container 30 is particularly useful for rural residents who may leave money in the container 30 to purchase an equivalent amount of stamps from the mail carrier. This practice is customary in rural areas.

Figure 2:
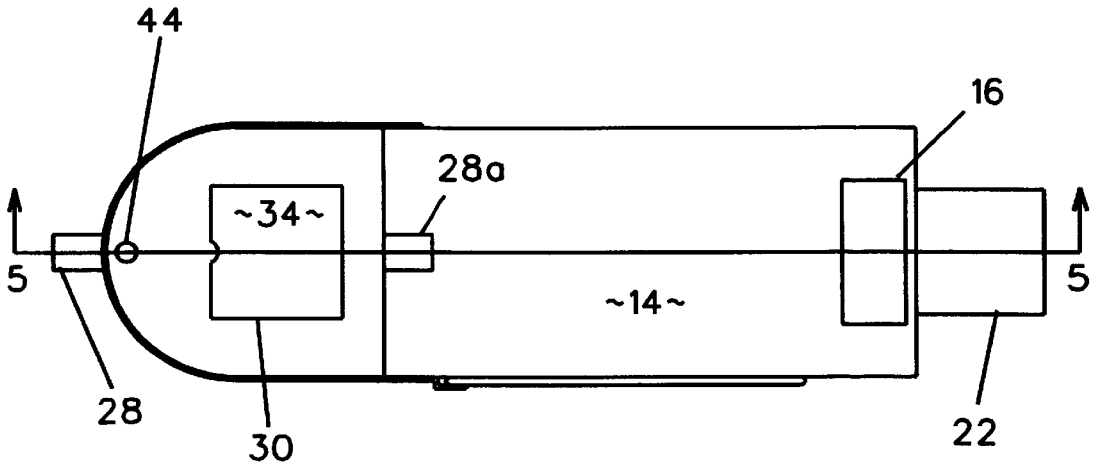
FIG. 2 is a top view of the mailbox lighting system as in FIG. 1.
Figure 3:
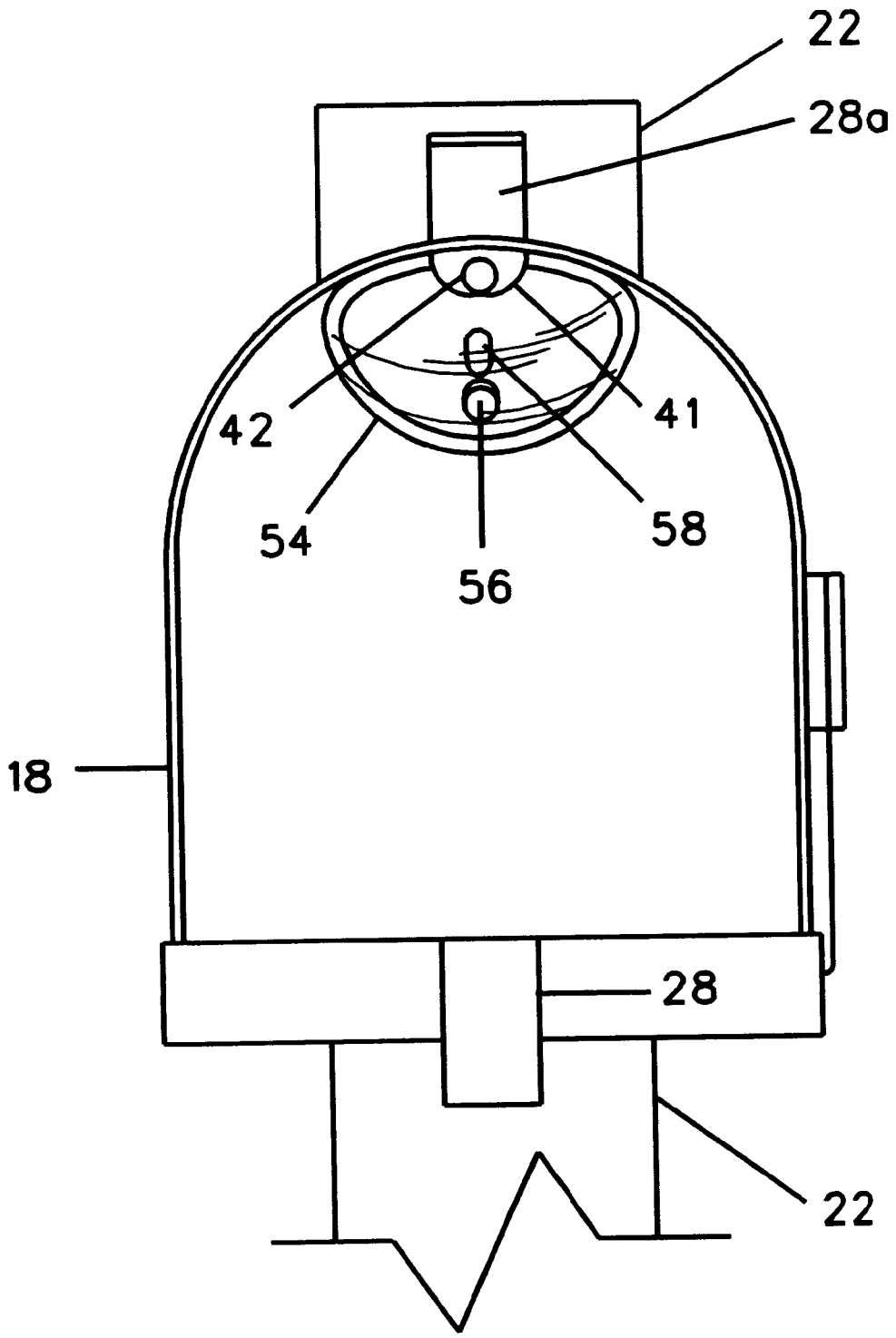
FIG. 3 is a front view of the mailbox lighting system as in FIG. 1.
Figure 4:
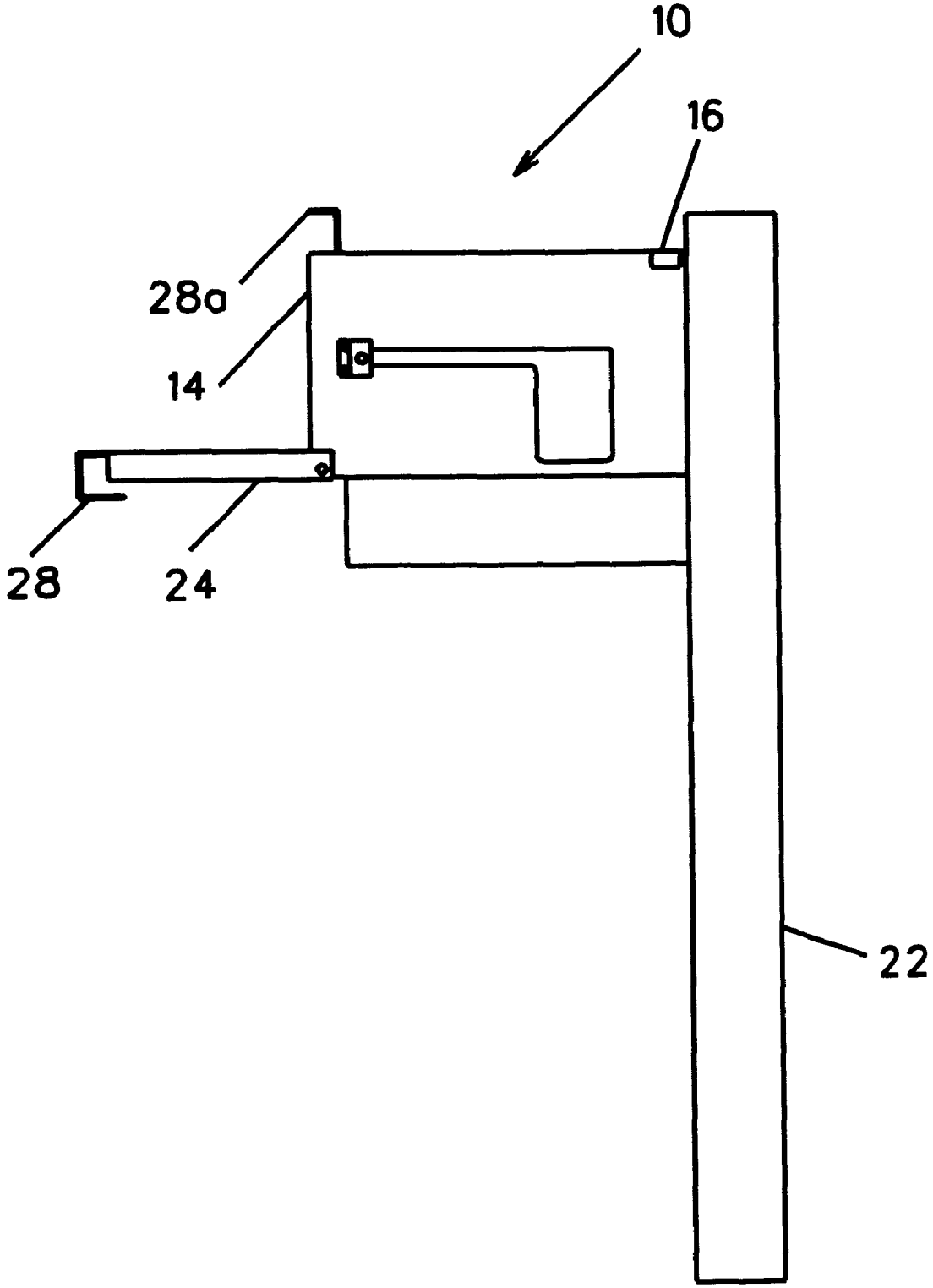
FIG. 4 is a right side view of the mailbox lighting system as in FIG. 1.
Figure 5:
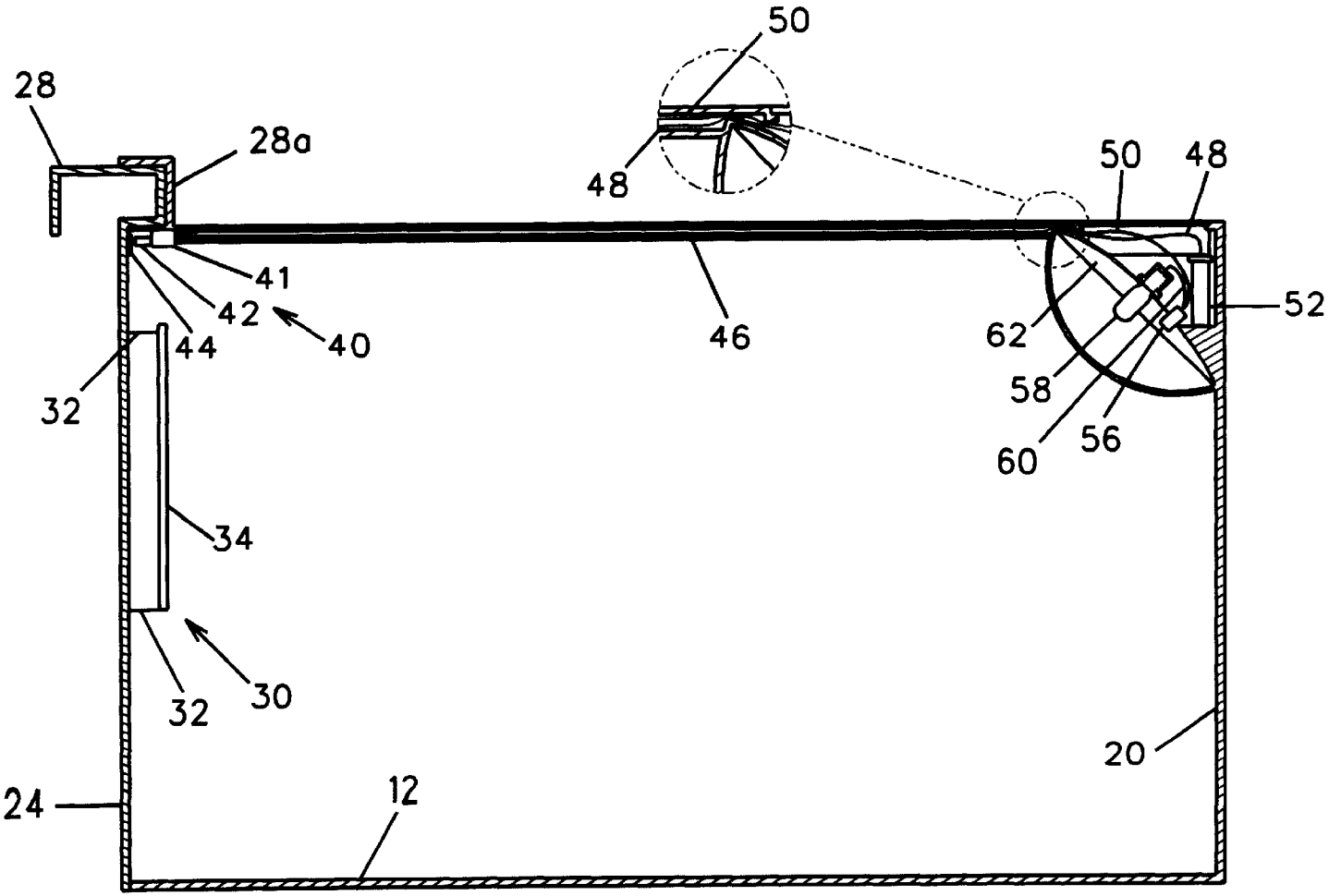
FIG. 5 is a sectional view of the mailbox lighting system taken along line 5—5 of FIG. 2 with the door in a closed configuration.
Figure 6:
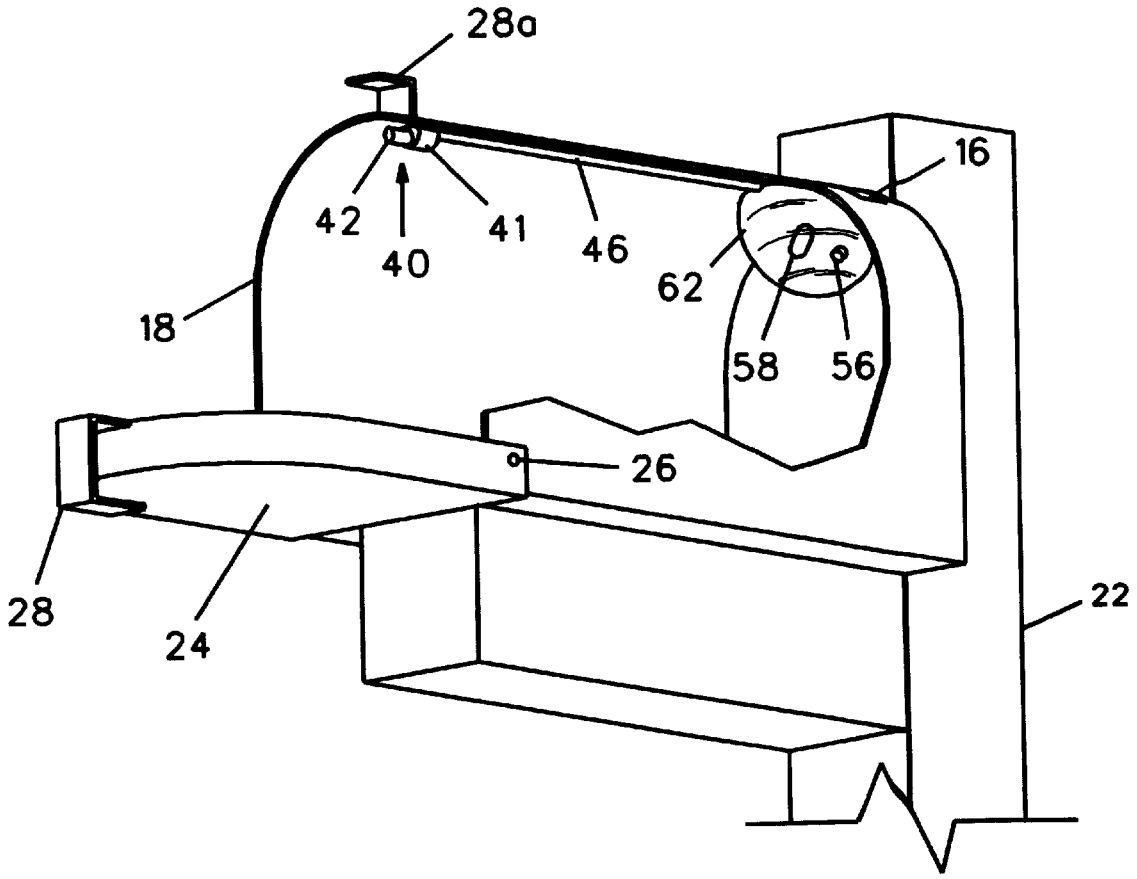
FIG. 6 is a perspective view of the mailbox lighting system with a portion of the mailbox removed.

The mailbox lighting system further includes an electromagnetic switch assembly 40 having a switch housing 41 mounted to the interior surface of the top wall 14 of the mailbox 10 for detecting when the door 24 has been opened. The switch assembly 40 includes a first magnet 42 coupled to the switch housing 41. The first magnet 42 is aligned with the latch 28*a* and adjacent to the front edge 18 of the top wall 14. A second magnet 44 is fixedly attached to the door 24 (FIGS. 1 and 2) such that the magnets 42, 44 are closely adjacent one another when the door 24 is in a closed position (FIG. 5). A first wire 48 extending through a protective channel 46 couples the switch assembly 40 to a battery 52 that is mounted within a light housing 54. The light housing 54 is fixedly attached to both a rear wall 20 and the top wall 14 of the mailbox 10. The housing 54 is preferably constructed of a transparent, rigid plastic material. An access door 16 is provided in the top wall 14 for replacement of the battery 52 (FIG. 1). It is understood that a motion sensor would be a suitable alternative to the electromagnetic switch assembly 40 for detecting an opening of the mailbox door 24.

A conventional photoelectric light switch including a photoelectric light sensor 56, commonly referred to as an "electric eye", is mounted within the light housing 54. When the door 24 of the mailbox 10 is opened and the magnets 42, 44 are thus separated, the magnetic switch assembly 40 is placed in a closed state such that electric current from the battery 52 is transmitted to the photoelectric light sensor 56 through a second wire 50. The energized photoelectric sensor 56 senses the level of ambient light within the interior of the mailbox 10. If a predetermined level of light is not detected, electric current is transmitted through the photoelectric switch to an incandescent lamp 58 mounted within the light housing 54 through a third wire 60. With the light source mounted within the mailbox proper, the mailbox can be repositioned on any post desired by a user without also having to reposition the light sensor. A reflective plate 62 is positioned within the light housing 54 such that light is reflected through the transparent housing into the interior of the mailbox.

In use, the electromagnetic switch assembly 40 is normally open so long as the magnets 42, 44 are immediately adjacent to one another. Upon an opening of the door 24, the switch 40 is closed which allows electricity to energize the photoelectric light sensor 56. If a threshold level of ambient light is not detected, electric current is allowed to energize the interior light 58. When the door 24 is again closed, current to the sensor 56 and lamp 58 is interrupted and the light, if energized, is extinguished. Thus, the interior lamp 58 is only energized if the door 24 is opened and a threshold level of ambient light is subsequently not detected by the photoelectric light sensor 56.

It is understood that the lamp 58 is energized, if at all, according to the level of ambient light initially detected by the light sensor upon an opening of the door 24. The photoelectric light switch is reset each time the door 24 is closed.

Figure 7:
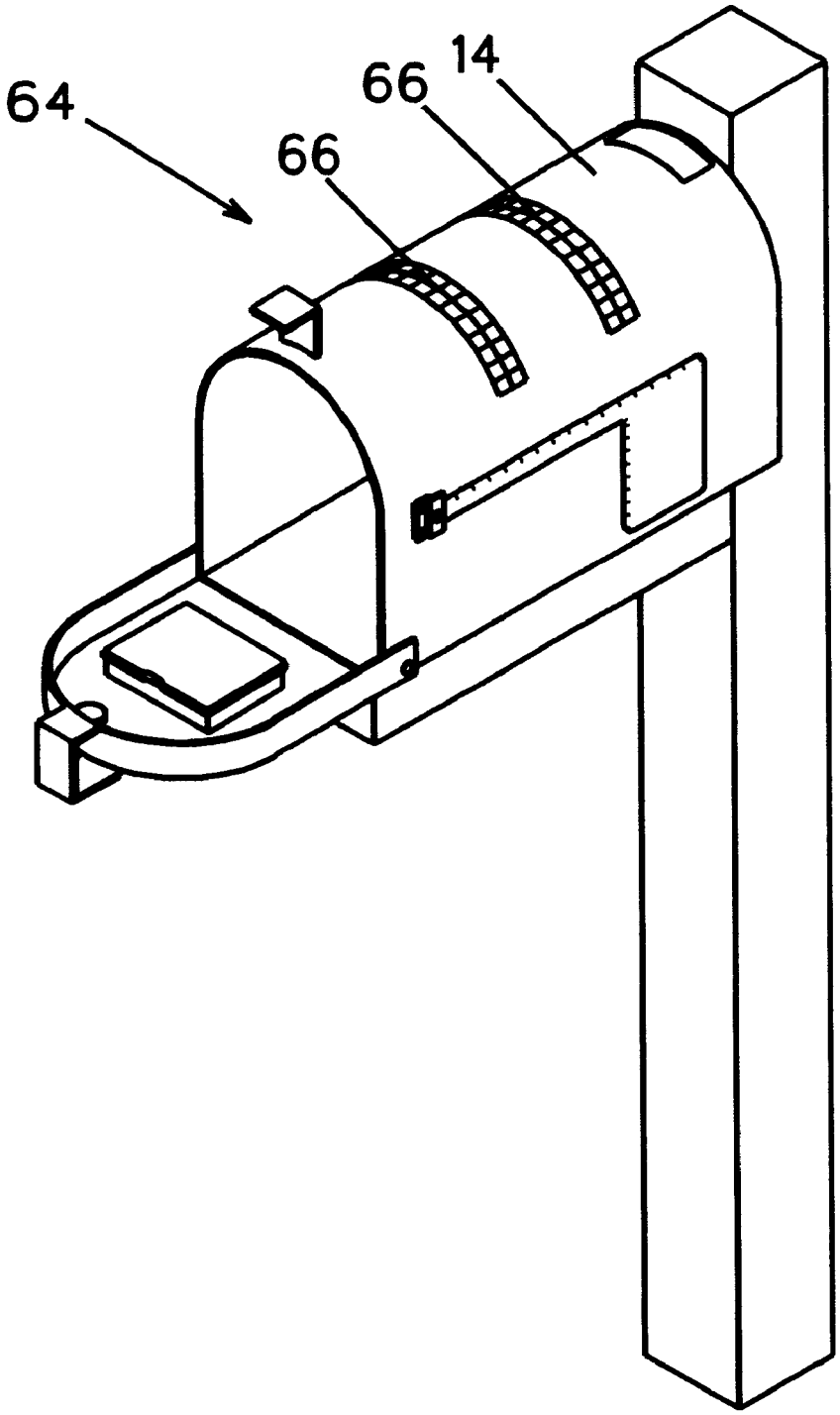
FIG. 7 is a perspective view of an alternative embodiment of the mailbox lighting system.

As shown in FIG. 7, an alternative embodiment of the mailbox lighting system 64 includes a pair of solar panels 66 mounted atop the top wall 14 of the mailbox. The lighting system operates as previously described except that the solar panels 66 provide a trickle charge to the battery 52. Thus, the useful life of the battery 52 is even further lengthened.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A system for illuminating the interior of a mailbox having a bottom wall, an arcuate top and side wall, a closed rear wall, an open front, and a hinged door pivoted about the bottom wall for selectively covering the front, the system comprising:

a light source positioned within the interior of the mailbox;

a power source;

a light sensor positioned within the interior of the mailbox for sensing the level of ambient light therein, the light sensor permitting current from the power source to energize the light source when the level of ambient light is below a predetermined level; and switch means for permitting current from the power source to energize the light sensor when the mailbox door is opened.

2. A lighting system as in claim 1 wherein the switch means includes an electromagnetic switch assembly, the switch assembly including:

a first magnet mounted to the top wall within the mailbox; and a second magnet positioned on the mailbox door adjacent the first magnet when the door is in a closed configuration, the switch assembly permitting current to be transmitted from the power source to the light sensor when the second magnet is displaced from the first magnet upon an opening of the mailbox door.

3. A lighting system as in claim 2 wherein the electromagnetic switch assembly presents a circuit that is open when the first magnet is adjacent to the second magnet and closed when the second magnet is displaced from the first magnet upon an opening of the mailbox door, the circuit permitting current to be transmitted from the power source to the light sensor when the first and second magnets are displaced from one another.

4. A lighting system as in claim 1, wherein the light source is an incandescent light, the system further including a reflective plate positioned adjacent the incandescent light within the mailbox for reflecting light from the lamp throughout the interior of the mailbox.

5. A lighting system as in claim 1 wherein the power source is a battery.

6. A lighting system as in claim 5 further comprising a solar cell positioned atop the top wall of the mailbox for collecting solar energy and providing a trickle charge to the battery, whereby the battery is repeatedly recharged for use.

7. A lighting system as in claim 1 further including a container positioned on an interior surface of the door including a pivotal lid.

8. A system for illuminating the interior of a mailbox having a bottom wall, an arcuate top and side wall, a closed rear wall, an open front, and a hinged door pivoted about the bottom wall for selectively covering the front, the system comprising:

a housing positioned within the interior of the mailbox adjacent the rear wall;

a light source positioned within the housing;

a battery power source positioned within the housing;

a light sensor positioned within the housing for sensing the level of ambient light within the interior of the mailbox, the light sensor permitting current from the power source to energize the light source when the level of ambient light is below a predetermined level; and switch means positioned within the mailbox adjacent the door for permitting current from the power source to energize the light sensor when the mailbox door is opened.

9. A lighting system as in claim 8, wherein the light source is an incandescent light, the system further comprising a reflective plate positioned within the housing such that light from the incandescent light is reflected into the interior of the mailbox.

10. A lighting system as in claim 8 wherein the switch means includes an electromagnetic switch assembly, the switch assembly including:

a switch housing mounted to the top wall within the mailbox;

a first magnet coupled to the switch housing; and a second magnet positioned on the mailbox door adjacent the first magnet when the door is in a closed configuration, the switch assembly permitting current to be transmitted from the power source to the light sensor when the second magnet is displaced from the first magnet upon an opening of the mailbox door.

11. A lighting system as in claim 8 further comprising a solar cell positioned atop the top wall of the mailbox for collecting solar energy and providing a trickle charge to the battery, whereby the battery is repeatedly recharged for use.

12. A lighting system as in claim 8 further comprising a box including a pivotal lid, positioned on an interior surface of the door.

13. A lighting system as in claim 8 wherein the housing is transparent for permitting ambient and incandescent light to pass through the housing.

14. A system for illuminating the interior of a mailbox having a bottom wall, an arcuate top and side wall, a closed rear wall, an open front, and a hinged door pivoted about the bottom wall for selectively covering the front, the system comprising:

an incandescent light positioned within the interior of the mailbox;

a power source;

a light sensor positioned within the interior of the mailbox for sensing the level of ambient light therein, the light sensor permitting current from the power source to energize the incandescent light when the level of ambient light is below a predetermined level; and an electromagnetic switch assembly positioned adjacent the door of the mailbox for permitting current from the power source to energize the light sensor when the mailbox door is opened.

15. A lighting system as in claim 14 wherein the electromagnetic switch assembly includes a first magnet mounted to the top wall within the mailbox, and a second magnet positioned on the mailbox door adjacent the first magnet when the door is in a closed configuration, the switch assembly permitting current to be transmitted from the power source to the light sensor when the second magnet is displaced from the first magnet upon an opening of the mailbox door.

16. A lighting system as in claim 14 further comprising a reflective plate positioned within the mailbox adjacent the incandescent light for reflecting light from the lamp throughout the interior of the mailbox.

17. A lighting system as in claim 14 wherein the power source is a battery.

18. A lighting system as in claim 17 further comprising a solar cell positioned atop the top wall of the mailbox for collecting solar energy and providing a trickle charge to the battery, whereby the battery is repeatedly recharged for use.

19. A lighting system as in claim 14 further comprising a container positioned on an interior surface of the door including a pivotal lid.

20. A lighting system as in claim 14 further comprising a housing formed of a transparent material and positioned within the interior of the mailbox for encasing the incandescent light, the power source, and the light sensor, the housing including a reflective plate positioned adjacent the incandescent light for reflecting light throughout the interior of the mailbox.

* * * * *